United States Patent [19]

Larsen

[11] Patent Number: 4,689,976

[45] Date of Patent: Sep. 1, 1987

[54] POP-UP HANDLE ASSEMBLY

[75] Inventor: Marvin L. Larsen, New Hampton, Iowa

[73] Assignee: Tri/Mark Corporation, New Hampton, Iowa

[21] Appl. No.: 874,402

[22] Filed: Jun. 16, 1986

[51] Int. Cl.[4] ..... E05B 13/00

[52] U.S. Cl. ..... 70/208; 70/140; 70/216; 70/361

[58] Field of Search ..... 70/208, 215, 216, 361, 70/473, 476, 478, 480, 481, 487, 152, 417, 140; 292/336.3, 347

[56] References Cited

U.S. PATENT DOCUMENTS

| | | | |
|---|---|---|---|
| 1,853,564 | 4/1932 | Jacobi | 70/208 |
| 2,536,295 | 1/1951 | Leonard | 70/208 |
| 3,111,833 | 11/1963 | Dettmer | 70/208 |
| 3,122,012 | 2/1964 | Christopher | 70/140 |
| 3,222,899 | 12/1965 | Bodoh et al. | 70/140 |
| 3,234,765 | 2/1966 | Kerr | 70/208 |
| 3,438,227 | 4/1969 | Wolniak | 70/208 |
| 3,659,444 | 5/1972 | Wellekens | 70/208 |
| 4,132,092 | 1/1979 | Steinbach | 70/208 |
| 4,552,001 | 11/1985 | Roop | 70/208 |

FOREIGN PATENT DOCUMENTS

| | | | |
|---|---|---|---|
| 2351975 | 4/1974 | Fed. Rep. of Germany | 70/361 |
| 804199 | 10/1936 | France | 70/208 |

*Primary Examiner*—Richard J. Scanlan, Jr.
*Assistant Examiner*—Anthony Knight
*Attorney, Agent, or Firm*—Wood, Dalton, Phillips, Mason & Rowe

[57] ABSTRACT

A pop-up handle assembly having a base with a mounting panel and a tubular housing and a handle with a tubular stem axially movable within a hollow sleeve rotatable within the tubular housing. The handle mounts a key-plug which is depressable to release a lock pin carried by the tubular stem from engagement with a shoulder in the tubular housing whereby the handle pops-up to an operative position under the urging of a spring. The key-plug is rotatable between locked and unlocked positions and into an unlocked position can be depressed to release the handle for movement without the use of a key. The handle assembly has provision for pop-up of the handle from the inner side thereof to free the handle for rotation regardless of whether the key-plug is either locked or unlocked.

21 Claims, 12 Drawing Figures

10
10

POP-UP HANDLE ASSEMBLY

TECHNICAL FIELD

This invention pertains to a pop-up handle assembly primarily intended for a topper for a pick-up truck or a garage door which is operable to control the position of a latch for the door of the garage or the topper. The pop-up handle assembly has structure providing for increased security, for operability from within the topper or a garage when the handle is locked and provision for release of the handle for pop-up by depression of a depressible member associated with the handle. The depressible member can be a key-plug which is operable without the use of a key when the key-plug is in a rotative unlocked position.

BACKGROUND ART

A commonly used handle for a garage door or the door of a pick-up topper is an inexpensive T-handle that utilizes a locking pin that nests within a slot in the base when a key-plug is rotated to the locked position. Release of the handle for operation requires rotating the key-plug to an unlocked position. With a conventional mounting for such a handle the fastener heads for the base of the handle assembly are always accessible providing low security and the handle is always in an easily gripped position allowing a substantial amount of torque to be applied to it for forced entry.

Locks having a pop-up handle are used with vending machines to provide high security. An example of this type of lock is shown in the Dettmer U.S. Pat. No. 3,111,833 wherein a handle has a rotatable key-plug associated with it. It is typical of this type of structure that a key must always be used in order to free the handle for movement to operative position.

It is also known in the art to have a depressable push button mounted within a handle and which can be depressed to release latch members which permit a spring to become operative to extend a handle to an operative position. A structure of this type is shown in the Leonard U.S. Pat. No. 2,536,295.

DISCLOSURE OF THE INVENTION

A primary feature of the invention is to provide a relatively low cost pop-up handle assembly and more particularly an assembly having a handle with structural features reducing the likelihood of forced entry through a door having the handle assembly. The handle assembly has a rotatable key-plug with the key-plug being depressable to permit pop-up of the handle without the use of a key. The handle can be freed for movement to an operative position by movement of an inside handle which by rotation thereof releases a latch controlled by the handle assembly. This operation can be achieved even with the handle locked from the outside.

An object of the invention is to provide a pop-up handle assembly having a handle with a rotatable key-plug associated therewith which can move between a locked and unlocked position and which can be depressed when in an unlocked position to free the handle for movement from a closed position to an operative position without the use of a key.

Still another object of the invention is to provide a pop-up handle assembly having a base attachable to a structure to be locked and a T-handle which, when in closed position, coacts with the base to prevent rotation of the handle. The handle can be released for movement to an operative position and freed for rotation by depression of a key-plug. Alternatively to depression of the key-plug a drive-bar of the handle assembly can be rotated from within the structure to free the handle for movement to an operative position regardless of whether the key-plug is in locked or unlocked position.

Still another object of the invention is to provide a pop-up T-handle assembly wherein a base is attachable to a structure to be locked and the handle is shaped to enclose the base and the attaching fasteners for the handle assembly are concealed, and the handle closely conforms to the base and cannot be firmly grasped by hand preventing application of sufficient torque to gain forced entry.

Still another object of the invention is to provide a pop-up T-handle assembly comprising, a base with a generally planar mounting panel and a tubular housing, a T-handle having a section with a peripheral lip which in handle-closed position encloses the mounting panel and precludes rotation of the T-handle, means urging the T-handle section to an operative position remote from said mounting panel, a drive-bar rotatably mounted by the tubular housing for operating a latch, means within the tubular housing for drivingly connecting the T-handle with the drive-bar, a depressible key-plug carried by the T-handle, means locking the T-handle in closed position, means operable upon depression of the key-plug to release said locking means and permit pop-up of the T-handle, and means operable by rotation of the drive-bar when the T-handle is in closed position to release said locking means and permit pop-up of the T-handle independent of the locked or unlocked condition of the key-plug.

A further object of the invention is to provide a pop-up handle assembly comprising, a base with a generally planar mounting panel for attachment to a door or the like and a tubular housing, a T-handle having a section with a peripheral lip which in handle-closed position encloses the mounting panel and precludes rotation of the T-handle, spring means urging the T-handle section away from the base to an operative position remote from said mounting panel, a drive-bar rotatably mounted by the tubular housing for operating a latch, means within the tubular housing for drivingly connecting the T-handle with the drive-bar, a depressible key-plug carried by the T-handle and movable between locked and unlocked positions, means locking the T-handle in closed position against the action of the spring means, and means operable upon depression of the key-plug to release said locking means and permit pop-up of the T-handle under the urging of the spring means.

A further object of the invention is to provide a pop-up handle assembly comprising, a base with a planar mounting panel and a tubular housing, a hollow sleeve rotatable in said tubular housing and drivingly connected to a drive-bar, an exposed handle having a tubular stem movable lengthwise in said hollow sleeve and keyed thereto for rotation therewith, spring means mounted within the hollow sleeve for urging the tubular stem outwardly of the hollow sleeve, a key-plug mounted in said tubular stem for rotational and axial movement, releasable locking means for locking the tubular stem and hollow sleeve against rotation and movement of the tubular stem outwardly of the hollow sleeve, and means on the key-plug operable in response to axial movement thereof to release said releasable locking means to permit movement of the handle and tubular stem outwardly of the hollow sleeve and rotation of the handle and hollow sleeve to rotate the drive bar.

BEST MODE FOR CARRYING OUT THE INVENTION

Figure 1:
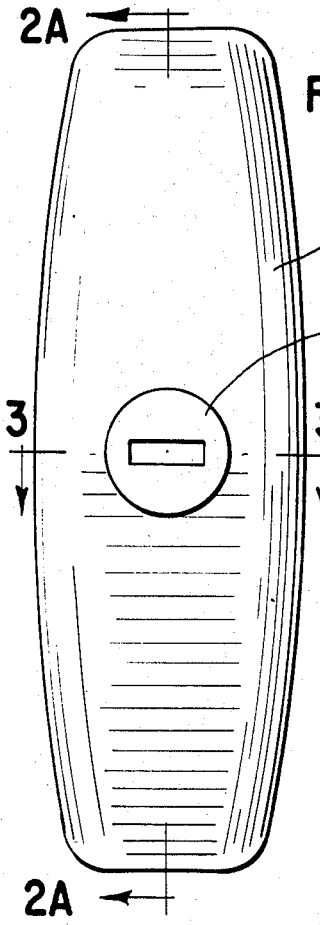
FIG. 1 is a front elevational view of the pop-up handle assembly.
Figure 2A:
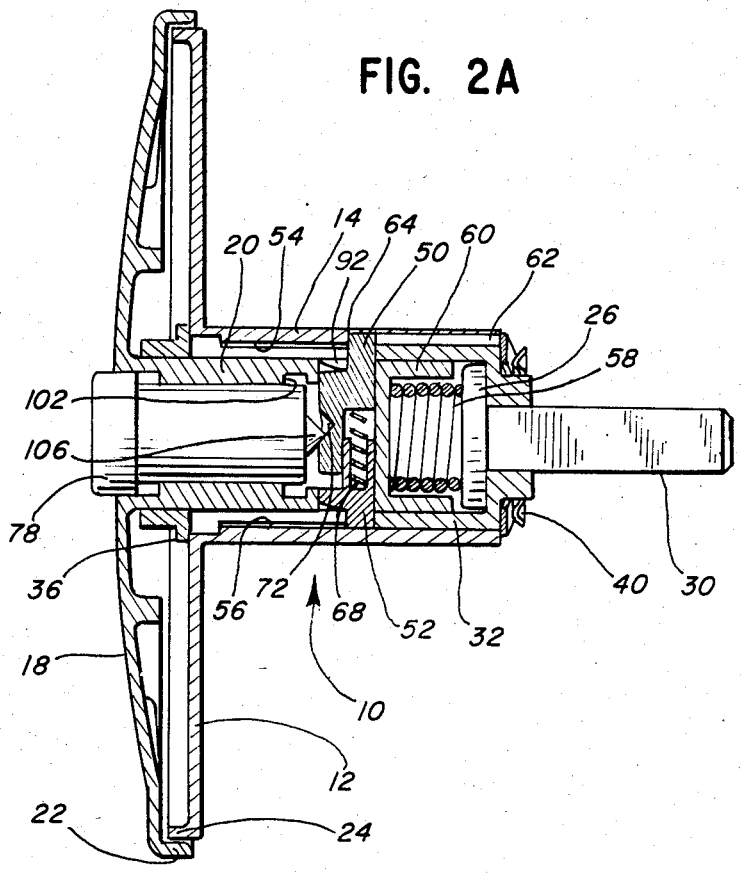
FIG. 2A is a longitudinal sectional view taken generally along the line 2-A in FIG. 1 with the handle assembly in lock position.
Figure 3:
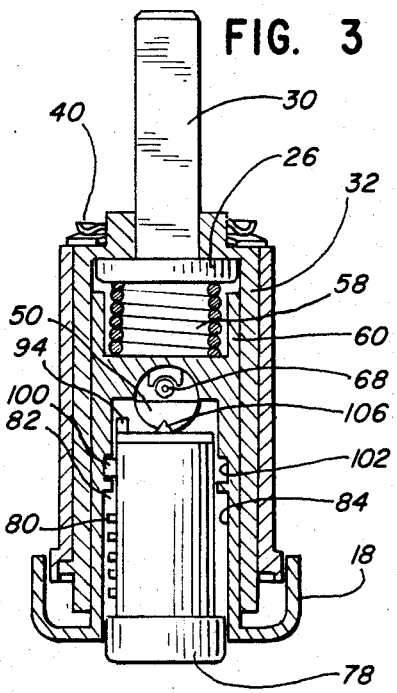
FIG. 3 is a plan section taken generally along the line 3—3 of FIG. 1.

The pop-up handle assembly is shown generally in FIGS. 1 and 2A and has a base indicated generally at 10 formed in one piece with a planar mounting panel 12 and a tubular housing 14. The mounting panel 12 can be positioned flush with the surface of a door such as a garage door or the door of a topper for a pick-up truck with the tubular housing 14 extending into the door structure for access to the interior of the space enclosed by the door. The mounting panel 12 has a pair of openings 16 for fasteners which secure the mounting panel to the door surface. The mounting panel 12 has a T-shape for coaction with a pop-up T-handle having an exposed handle section 18 formed integrally with a tubular stem 20. The handle section 18 is shown in a closed position in FIG. 2A and in an operative position in FIG. 2C. A peripheral lip 22 on the handle coacts with a raised peripheral flange 24 on the mounting panel 12 to conceal the fasteners extending through the openings 16 in the mounting panel 12 and to also preclude rotation of the handle when the handle is closed.

Figures 2C, 4, 5, 6, 7, 8, 9:
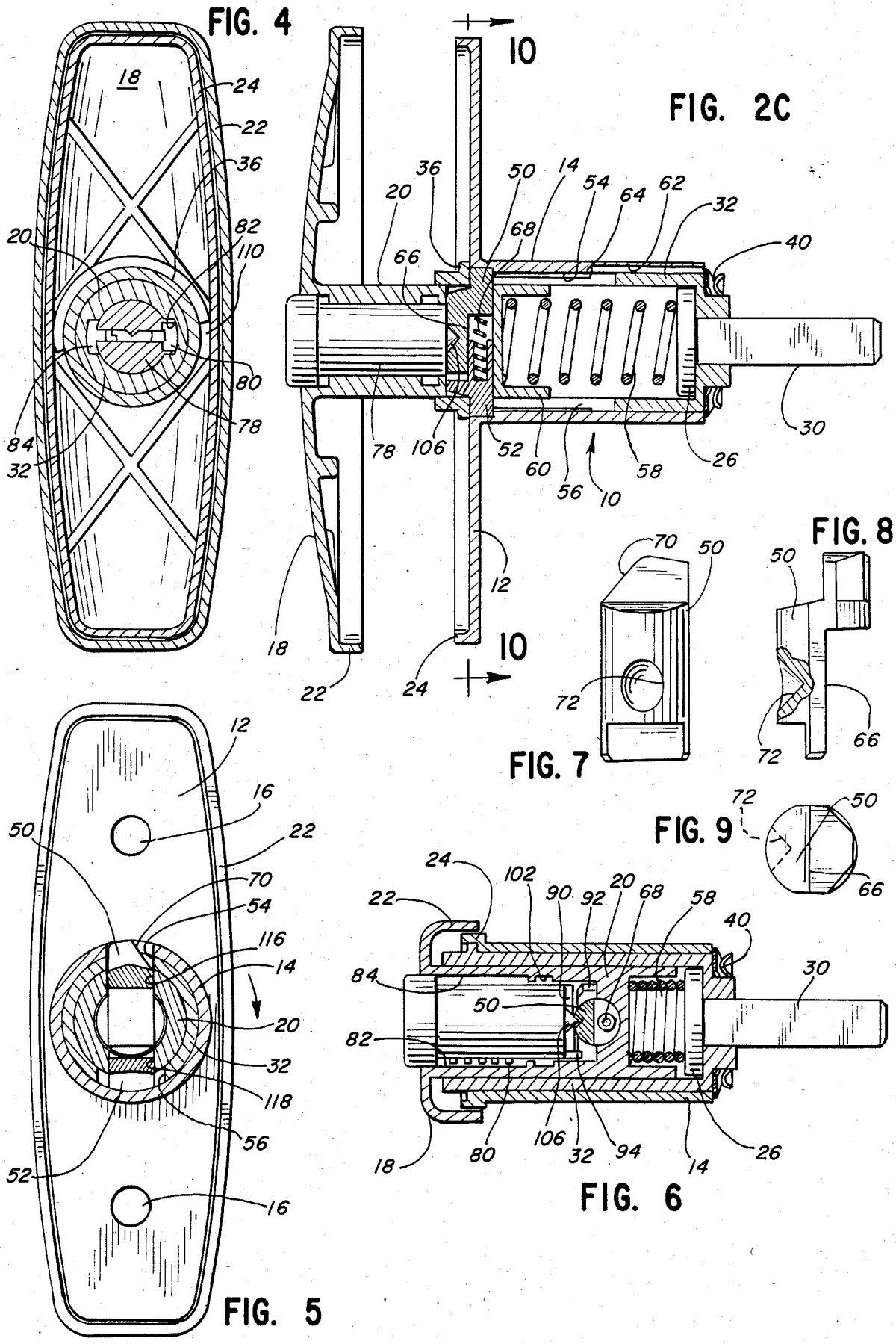
FIG. 2C is a view similar to FIG. 2A showing the handle in operative position.
FIG. 4 is a vertical section taken generally along the line 4—4 in FIG. 2B.
FIG. 5 is a rear elevational view with parts of the section taken generally along the line 5—5 in FIG. 2B.
FIG. 6 is a plan section taken generally along the line 6—6 in FIG. 2B.
FIG. 7 is a detailed plan view of a locking pin.
FIG. 8 is a side elevational view of the locking pin shown in FIG. 7.
FIG. 9 is an end view of the locking pin looking toward the top of FIG. 8.
Figure 10:
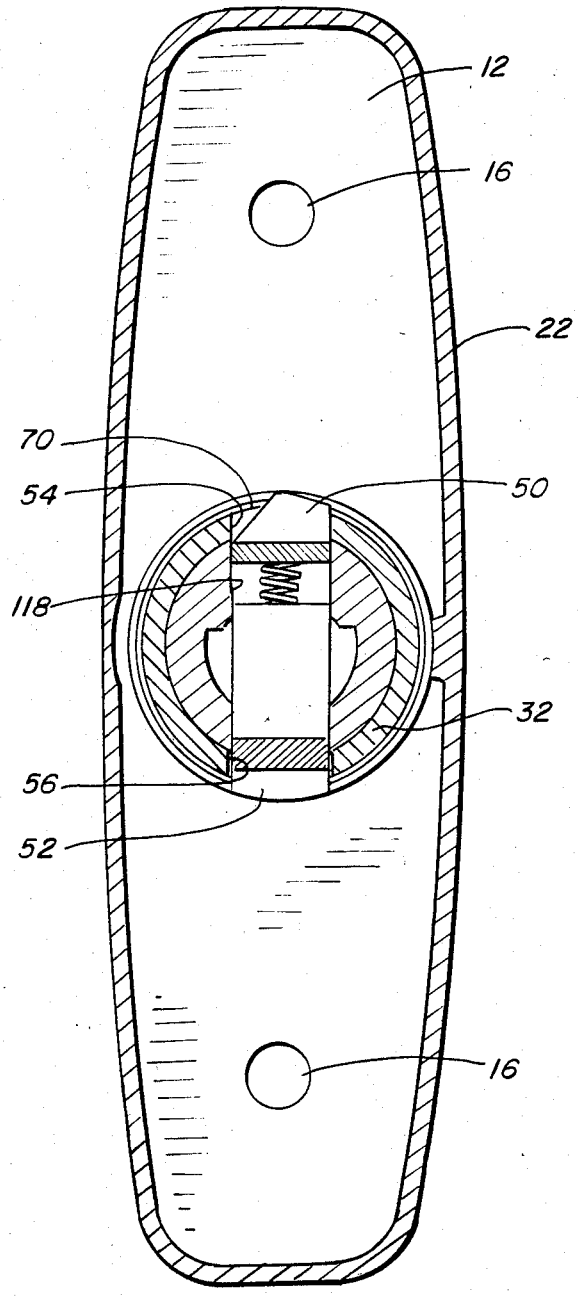
FIG. 10 is a sectional view on an enlarged scale, taken generally along line 10—10 in FIG. 2C.

When the handle is free for rotation in the operative position shown in FIG. 2C the rotation thereof imparts rotation to a drive-bar 30 which can be connected directly to a latch or to a linkage for moving a latch which holds the door closed.

The drive-bar 30 is rotatably mounted within the tubular housing 14 of the base by a rotatable hollow sleeve 32 having an opening 34 through which the drive-bar extends. The drive-bar and the opening 34 are shaped other than circular whereby there is a driving connection therebetween. In assembly, the drive-bar 30 is passed through the opening 34 and a head 26 at the end of the drive-bar retains the parts in association.

The hollow sleeve 32 is rotatable within the tubular housing 14 and is releasably held therein by means of a flange 36 on the hollow sleeve engageable against the mounting panel 12 adjacent an end of the tubular housing and at its opposite end by a spring washer 38 which abuts an inner end of the tubular housing 14. The spring washer is held in position by a retainer clip 40 engageable therewith and seated in a groove in a reduced diameter end of the hollow sleeve 32.

The tubular stem 20 of the handle has axial movement within the hollow sleeve 32 and these components are interconnected for rotation together whereby rotation of the handle will rotate the drive-bar 30 through rotation of the hollow sleeve 32. This coaction between the tubular stem 20 and the hollow sleeve 32 is provided by a lock pin 50 and a stop pin 52 carried by the tubular stem 20 and slidably keyed thereto as subsequently described and which can move along a pair of slots 54 and 56, respectively, in the wall of the hollow sleeve 32.

The outward movement of the handle to the operative position shown in FIG. 2C is caused by the urging of a spring 58 within the hollow sleeve 32 and extended between the head 26 of the drive-bar 30 and a cup-shaped end 60 of the handle tubular stem 20.

Means for locking the handle in the closed position shown in FIG. 2A comprises the locking pin 50 and an elongate recess 62 in the wall of the tubular housing 14 which terminates in a shoulder 64. This shoulder 64 engages with the lock pin 50 as seen in FIG. 2A whereby the spring 58 is ineffective to urge the handle outwardly to an operative position. The lock pin 50 is shown particularly in FIGS. 7–9 and has a flat surface 66 which engages a flat surface on the stop pin 52 and with the lock pin and stop pin are urged away from each other by a spring 68 positioned therebetween. The lock pin has an end with a cam surface 70 which is urged radially outward into engagement with the shoulder 64 on the tubular housing by the spring 68. A conically-shaped recess 72 is formed on the top side of the lock pin 50 for a purpose to be described.

Figure 2B:
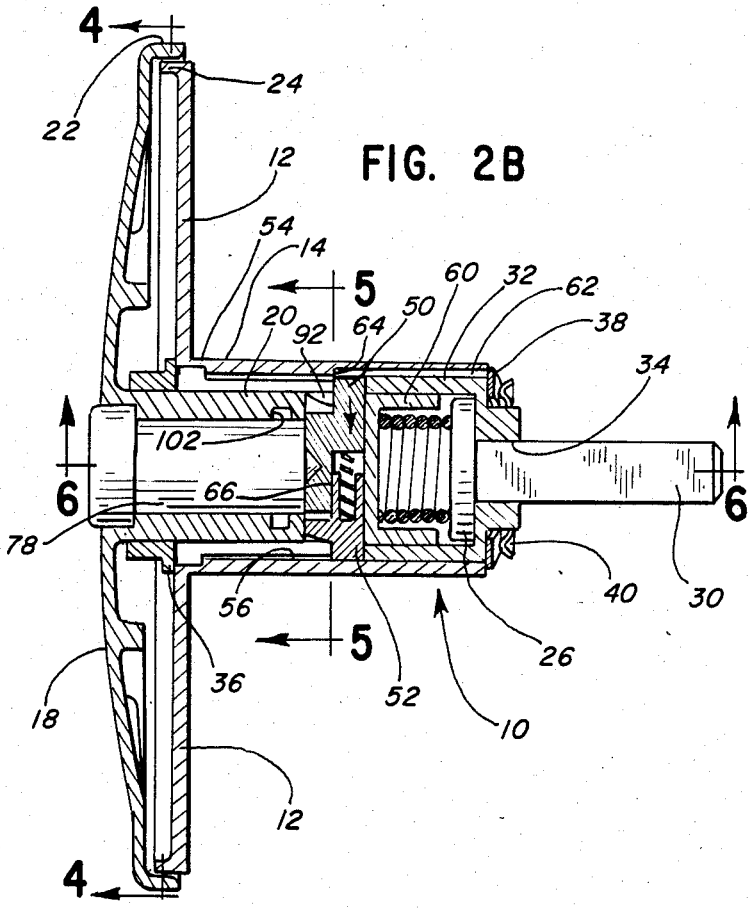
FIG. 2B is a view similar to FIG. 2A showing the parts positioned with the key-plug depressed and prior to pop-up of the handle.

The handle tubular stem 20 rotatably mounts a key-plug 78 which in addition to rotation can be depressed from the position of FIG. 2A to the position shown in FIG. 2B. This key-plug is a commercially available construction available from Hudson Lock, Inc. and is used in their locks including their drawer lock KCWDL875. The key-plug has a series of retractable wafers 80 which can be withdrawn by insertion of a key into the key-plug.

Referring to FIG. 4, the wafers 80 are shown positioned in an elongate slot 82 in the inner wall of the tubular stem 20 which is the unlocked position of the key-plug. The key-plug 78 is in a locked position when the wafers 80 are positioned within a diametrically opposite elongate slot 84 formed in the wall of the tubular stem 20. When in the locked position a surface 90 on the inner end of the key-plug 78 overlies an arcuate surface 92 on the tubular stem whereby the key-plug cannot be depressed. When the key-plug is rotated to an unlocked position the surfaces 90 and 92 are out of alignment whereby the key-plug can be depressed. A projection 94 on the inner end of the key-plug can move between opposite ends of the arcuate surface 92 on the tubular stem to limit rotation of the key-plug to positions wherein the wafers 80 align with one or the other of the slots 82 and 84.

The key-plug is limited in its axial movement by coaction between a wafer 100 fixed to and extending outwardly of the key-plug 78 which is confined within an annular groove 102 in the tubular stem. The annular groove has a width dimension greater than the width of the wafer 100 and sufficient to permit depression of the key-plug 78 from the position shown in FIG. 2A to the position shown in FIG. 2B.

The inner end of the key-plug 78 has a centrally aligned projecting cone 106. When the key-plug 78 is depressed the cone 106 engages the wall of the conical recess 72 in the lock pin 50 and cams the lock pin 50 inwardly to withdraw the end thereof from the shoulder 64 of the tubular housing 14 which enables the spring 58 to cause pop-up of the handle 18 to the operative position shown in FIG. 2C. With the key-plug 78 depressed the cone 106 is fully seated in the conical recess 72 of the lock pin 50 as seen in FIG. 2B. This withdraws the lock pin 50 from the shoulder 64 and the spring 58 causes the handle to pop-up. Initial outward movement of the handle brings the lock pin 50 into a position where it can move out radially a slight distance under the urging of the spring 68 which offsets the cone 106 from the conical recess 70. This camming action urges the key-plug 78 to its outer position as seen in FIG. 2C.

With the handle in operative position rotation thereof causes rotation of the drive-bar 30 because of the interconnection of the stem 20 with the hollow sleeve 32 by the keying action of the lock pin 50 and stop pin 52. Rotation of the handle is limited to less than 180° to avoid the possibility of the handle being moved to closed position when out of alignment with the mounting panel 12. This movement is controlled by the flange 36 which has an arc of 180° as seen in FIG. 4 and with opposite ends thereof being brought rotatively into abutment with a stop surface 110 on the outer face of the mounting panel 12 and which has an arc of length of approximately 20°, resulting in overall rotation of approximately 160°.

With the handle in closed position the handle cannot be rotated because of the coaction between the lip 22 on the handle and the flange 24 on the mounting panel 12. This condition exists regardless of the rotative position of the key-plug in either lock or unlocked position. In either instance, it is possible to pop-up the handle from the inner side of the handle assembly and to thus permit rotation of the drive-bar 30 from within a garage or other structure having the handle assembly. This avoids being shut in either unintentionally or as a result of a deliberate malicious attempt to lock someone inside a garage or a topper for a pick-up truck.

This function is achieved by the cam surface 70 on the lock pin 50 which coacts with an edge of the slot 54. As the drive-bar 30 is rotated there is a resulting rotation of the hollow sleeve 32. The lock pin 50 is slidably keyed within a hole 116 in the tubular stem 20 and the stop pin 52 is slidably keyed within a hole 118 in the tubular stem. Since the tubular stem 20 cannot rotate when the handle is closed and the drive bar 30 is rotated the slot 56 in the hollow sleeve 32 is made considerably wider than the width of the stop pin 52 as seen in FIG. 5. The slot 56 narrows toward the end of the hollow sleeve adjacent the handle to avoid lost motion when rotating the handle, when the handle is open. As a result, when the handle is closed, rotation of the hollow sleeve 32 relative to the tubular stem 20 can occur. This rotation causes a camming action between the cam surface 70 and an edge of the slot 54 in the hollow sleeve to retract the lock pin 50 from the shoulder 64 with resulting pop-up of the handle under the urging of the spring 58. The outward movement of the handle is limited by engagement of the lock pin 50 and stop pin 52 with an end wall of the hollow sleeve at the ends of the hollow sleeve slots 54 and 56 as seen in FIG. 2C. With pop-up of the handle 18 there is complete freedom of rotation from the inner side of the handle assembly.

In operation with the handle closed and the key-plug 78 locked a person first inserts a key into the key-plug 78 and rotates the key-plug through 180° from locked position to unlocked position. The key-plug is then depressed to release the lock pin 50 and the spring 58 causes the handle to pop up where it is free for rotation to release a latch connected to the handle assembly. The handle can be returned to initial position and depressed to bring the lock pin 50 back into engagement with the shoulder 64 to place the handle in closed position and when the handle is to again be moved to operative position it is only necessary to depress the key-plug 78 without requirement for the use of a key.

It will be evident that the key-plug functions as a depressible member and new and improved results are achieved even without the locking function derived from rotation of the key-plug.

The assembly shown provides for clockwise handle rotation. The structure can provide for counter-clockwise handle rotation by changing the location of the ends of the flange 36 and changing the direction in which the cam surface 70 on the locking pin 50 faces.

The specific handle shown is a T-handle; however, it will be evident that other shapes such as an L-handle can embody the invention.

I claim:

1. A pop-up T-handle assembly comprising, a base with a generally planar mounting panel for attachment to a support and a tubular housing, a T-handle having a section with a peripheral lip which in a handle-closed position encloses the mounting panel and precludes rotation of the T-handle, spring means urging the T-handle section away from the base to an operative position remote from said mounting panel, a drive-bar rotatably mounted by the tubular housing, means within the tubular housing for drivingly connecting the T-handle with the drive-bar, a depressible key-plug carried by the T-handle and movable between locked and unlocked positions, means preventing depression of the key-plug when in locked position, means locking the T-handle in closed position against the action of the spring means, and means operable upon depression of the key-plug to release said locking means and permit pop-up of the T-handle under the urging of the spring means.

2. A pop-up handle assembly for operating a latch comprising, a base, a handle supported by said base for axial and rotational movement, a drive member supported by said base for connection to a latch, means interconnecting said handle and drive member for rotation together and relative axial movement, locking means locking said handle against axial movement, a key-plug mounted in said handle for rotational movement between locked and unlocked positions and for axial depressing movement when in unlocked position, means preventing depression of the key-plug when in locked position, and coacting means on the key-plug and said locking means to release the locking means by depressing the key-plug when the latter is in unlocked position to release the handle for axial movement.

3. A pop-up handle assembly as defined in claim 2 wherein said locking means includes a retractable locking pin, and means responsive to rotation of said drive member to retract said locking pin and release the locking means regardless of the position of the key-plug.

4. A pop-up handle as defined in claim 3 wherein said locking pin has a cam surface, and said key-plug has a cam engageable with the cam surface as the key-plug is depressed to shift the locking pin.

5. A pop-up handle as defined in claim 2 including a spring to move said handle axially when the locking means is released.

6. A pop-up handle as defined in claim 5 including coacting means on the locking means and the interconnecting means for holding the locking means released.

7. A pop-up handle as defined in claim 2 wherein said base has a generally planar mounting panel, and said handle is shaped to overlie and enclose said mounting panel when the handle assembly is locked and the handle is in closed position.

8. A pop-up handle as defined in claim 7 wherein said handle has a peripheral lip to surround the edge of said mounting panel and which prevents rotation of the handle when the handle is closed.

9. A handle assembly comprising, a base, a handle supported by said base for rotational movement, a driven mechanism supported by said base, means interconnecting said handle and driven mechanism for rotation together, locking means for said handle, a key-plug mounted in said handle for axial movement and for rotational movement between locked and unlocked positions, means preventing axial movement of the key-plug when in locked position, and coacting means on the key-plug and said locking means to release the locking means by depressing the key-plug when the latter is in unlocked position.

10. A pop-up handle assembly comprising, a base with a planar mounting panel and a tubular housing, a hollow sleeve rotatable in said tubular housing and drivingly connected to a drive-bar, an exposed handle having a tubular stem movable lengthwise in said hollow sleeve and keyed thereto for rotation therewith, spring means mounted within the hollow sleeve for urging the tubular stem outwardly of the hollow sleeve, a key-plug mounted in said tubular stem for rotational and axial movement, means preventing axial movement of the key-plug in a locked position thereof, releasable locking means for locking the tubular stem and hollow sleeve against rotation and movement of the tubular stem outwardly of the hollow sleeve, and means on the key-plug operable in response to axial movement thereof to release said releasable locking means to permit movement of the handle and tubular stem outwardly of the hollow sleeve and rotation of the handle and hollow sleeve to rotate the drive bar.

11. A pop-up handle assembly as defined in claim 10 wherein said handle has a section extending normal to said tubular stem and shaped to overlie and enclose said planar mounting panel.

12. A pop-up handle assembly as defined in claim 10 wherein said key-plug is rotatable between locked and unlocked positions, and said means for preventing axial movement of the key-plug when in locked position comprises surfaces on the tubular stem and the key-plug.

13. A pop-up handle assembly as defined in claim 12 wherein said tubular stem has an internal groove and a wafer extending outwardly of the key-plug and into said internal groove to limit axial movement of the key-plug.

14. A pop-up handle as defined in claim 10 wherein said locking means includes a locking pin movably carried by said tubular stem, an elongate slot in said hollow sleeve, a shoulder on the inner wall of said tubular housing, a spring urging said locking pin outwardly through said elongate slot to engage against said shoulder, and said means on the key-plug engages said locking pin to retract said locking pin from said shoulder, and said spring means includes a spring acting between said tubular housing and said tubular stem to urge the handle and tubular stem outwardly of the tubular housing when the locking pin is disengaged from said shoulder.

15. A pop-up handle as defined in claim 14 wherein said locking pin has a sloped cam surface at an end thereof engageable with a surface on said inner wall of the housing for retraction of the locking pin by rotation of the drive-bar to permit release of the handle and continued rotation of the drive-bar.

16. A pop-up handle as defined in claim 10 wherein said key-plug has plurality of key retractable wafers, a pair of diametrically opposed slots in said tubular stem for alternately receiving said wafers in the locked and unlocked positions of the key-plug, an additional wafer fixed on said key-plug, and an annular groove in said tubular stem for receiving said fixed wafer and limiting the movement of the key-plug axially of the tubular stem.

17. A pop-up handle assembly as defined in claim 10 including means urging the locking means to a locking position when the handle is returned to a closed position.

18. A pop-up handle as defined in claim 10 including means connecting said hollow sleeve and handle for rotation together, and coacting means on the hollow sleeve and said planar mounting panel for limiting rotation of said handle.

19. A pop-up T-handle assembly comprising, a base with a generally planar mounting panel and a tubular housing, a T-handle having a section with a peripheral lip which in handle-closed position encloses the mounting panel and precludes rotation of the T-handle, means urging the T-handle section to an operative position remote from said mounting panel, a drive-bar rotatably mounted by the tubular housing, means within the tubular housing for drivingly connecting the T-handle with the drive-bar, a depressible key-plug carried by the T-handle, means locking the T-handle in closed position, means operable upon depression of the key-plug to release said locking means and permit pop-up of the T-handle, and means operable by rotation of the drive-bar when the T-handle is in closed position to release said locking means and permit pop-up of the T-handle independent of the locked or unlocked condition of the key-plug.

20. A pop-up handle assembly comprising, a base with a generally planar mounting panel and a tubular housing, a handle having a section which in handle-closed position engages the mounting panel and precludes rotation of the handle, means urging the handle section to an operative position remote from said mounting panel, a drive-bar rotatably mounted by the tubular housing, means within the tubular housing for drivingly connecting the handle with the drive-bar, a depressible member carried by the handle, means locking the handle in closed position, means operable upon depression of the depressible member to release said locking means and permit pop-up of the handle, and means operable by rotation of the drive-bar when the handle is in closed position to release said locking means and permit pop-up of the handle independent of the depressible member.

21. A pop-up handle assembly comprising, a base with a mounting panel and a tubular housing, a hollow sleeve rotatable in said tubular housing and drivingly connected to a drive-bar, an exposed handle having a tubular stem movable lengthwise in said hollow sleeve and keyed thereto for rotation therewith, spring means mounted within the hollow sleeve for urging the tubular stem outwardly of the hollow sleeve, a depressible member mounted in said tubular stem for axial movement, releasable locking means for locking the tubular stem and hollow sleeve against rotation and movement of the tubular stem outwardly of the hollow sleeve, means on the depressible member operable in response to axial movement thereof to release said releasable locking means to permit movement of the handle and tubular stem outwardly of the hollow sleeve and rotation of the handle and hollow sleeve to rotate the drive bar, said locking means including a locking pin movably carried by said tubular stem, an elongate slot in said hollow sleeve, a shoulder on the inner wall of said tubular housing, a spring urging said locking pin outwardly through said elongate slot to engage against said shoulder, said means on the depressible member being engageable with said locking pin to retract said locking pin from said shoulder, said spring means including a spring acting between said tubular housing and said tubular stem to urge the handle and tubular stem outwardly of the tubular housing when the locking pin is disengaged from said shoulder, and said locking pin has a sloped cam surface at an end thereof engageable with a surface on said inner wall of the housing for retraction of the locking pin by rotation of the drive-bar to permit release of the handle and continued rotation of the drive-bar.

* * * * *